US005232124A

United States Patent [19]

Schneider et al.

[11] Patent Number: 5,232,124

[45] Date of Patent: Aug. 3, 1993

[54] PRESSURE RELIEF DEVICE AND METHOD

[75] Inventors: Scott W. Schneider, Beaver, Pa.; Ralph Oriola, Danielson, Conn.; Jay Lyons, Franklin, Conn.; Jerry Smith, Norwich, Conn.; Karl Enstrom, Groton, Conn.

[73] Assignee: Advanced Monobloc Corporation, Hermitage, Pa.

[21] Appl. No.: 849,161

[22] Filed: Mar. 10, 1992

[51] Int. Cl.[5] ..... B65D 83/14

[52] U.S. Cl. ..... 222/1; 222/397

[58] Field of Search ..... 222/1, 396, 397, 541; 220/207; 215/249, 260, 355

[56] References Cited

U.S. PATENT DOCUMENTS

| | | | |
|---|---|---|---|
| 2,072,816 | 3/1937 | Hill | 222/397 |
| 2,907,489 | 10/1959 | Taylor | 222/541 X |
| 3,145,884 | 8/1964 | Everett | 222/397 X |
| 3,155,292 | 11/1964 | Webster | 222/397 |
| 3,217,947 | 11/1965 | Bauerlein | 222/397 |
| 3,385,481 | 5/1968 | Frangos | 222/396 |
| 3,814,297 | 6/1974 | Warren | 222/402.13 |
| 3,834,589 | 9/1974 | Morane | 222/396 X |
| 3,842,796 | 10/1974 | Clark | 215/355 X |
| 3,880,187 | 4/1975 | Kneusel | 222/397 X |
| 4,979,651 | 12/1990 | Lee | 222/397 |

FOREIGN PATENT DOCUMENTS

| | | | |
|---|---|---|---|
| 1442755 | 3/1969 | Fed. Rep. of Germany | 222/541 |
| 2654379 | 8/1978 | Fed. Rep. of Germany | 222/397 |
| 702988 | 1/1954 | United Kingdom | 222/541 |

*Primary Examiner*—Andres Kashnikow
*Assistant Examiner*—Kenneth Bomberg

[57] ABSTRACT

The invention provides a pressure relief device for aerosol containers that may be subject to high internal pressures. The pressure relief device is a small plug formed of a rubber material. The plug has first and second bores extending inwardly from each end and defining between them a thin integral diaphragm separating the bores. A groove extends circumferentially around the device, and one end of the device is tapered so that it can be forced into a hole in the bottom of an aerosol container. The area and thickness of the diaphragm can be varied to control the pressure at which the diaphragm will rupture to relieve excess pressures in the container. The rupturable diaphragm is protected from damage during the insertion process, and when the container is on store shelves, by being located near the center of the device, protected by the bores on each side of the diaphragm.

15 Claims, 2 Drawing Sheets

PRESSURE RELIEF DEVICE AND METHOD

FIELD OF THE INVENTION

This invention relates to pressure relief devices. It relates particularly to pressure relief devices for aerosol containers that may be subject to high internal pressures.

BACKGROUND OF THE INVENTION

Aerosol containers have long presented a risk of explosion if over-pressures occur in the containers. Such explosions may occur when the container is subjected to high temperatures, e.g. when it is left in a very hot place, or when it is being disposed of or recycled.

If an explosion occurs when the container is left in a hot location such as an unattended automobile, this can cause considerable property damage. If an explosion occurs when the container is being incinerated, this can cause personal injury. For this reason, before aerosol containers are melted to reuse their metal, they are usually punctured. However, the spikes in the puncturing machines can miss a container, and if a pressurized container explodes in the molten metal in a furnace, the risk of injury and damage is particularly severe.

For the above and other reasons, various attempts have been made to provide pressure relief devices for aerosol containers. Typical such attempts are shown in U.S. Pat. No. 3,405,838 issued Oct. 15, 1968 to Preisendanz, U.S. Pat. No. 3,815,534 issued Jun. 11, 1974 to Kneusel, and U.S. Pat. No. 3,913,614 issued Oct. 21, 1975 to Speck.

The above identified attempts to provide aerosol container pressure relief devices have not in general been particularly successful. Their disadvantages include complexity, high cost of implementation, and difficulty in providing a narrow, precise range of pressures in which the relief device will vent.

The pressure relief device shown in the Kneusel patent has been used in some commercial aerosol containers. In this device, a pattern of lines is scored on the bottom of the aerosol container. The lines intersect at a common point to form a spoke-like design. The score lines weaken the bottom of the container, and the depth and number of lines determine the pressure at which the bottom will rupture. This arrangement obviously requires precise manufacturing operations to score the bottom of each container. Such operations are costly, difficult to perform, and are subject to imperfections which can affect the pressure at which the bottom of the container will rupture.

Recent developments have provided aerosol propellants that are considered more environmentally safe than previously, one such propellent being known as Propellent-22. While this propellent is preferable environmentally, it operates at a higher pressure than previous conventional propellants and has a steeper pressure/temperature curve (i.e. its pressure increases more steeply with temperature). This creates an increased risk of explosion unless a suitable pressure relief device is used.

Accordingly, it is an object of the present invention to provide a pressure relief device that is simple, inexpensive to manufacture, and which can be installed relatively easily and inexpensively in aerosol and other pressurized containers. The device of the invention may be designed to provide accurate pressure relief at a desired pressure range.

SUMMARY OF THE INVENTION

In one aspect, the invention provides a pressure relief device for use in pressurized containers such as aerosol containers, for relieving pressures in excess of a predetermined pressure, said device comprising:

(a) a body formed from a resilient material and having first and second ends, said body being shaped to fit within and to seal an opening in said container, (b) a first bore extending into said body from said first end and a second bore extending into said body from said second end, (c) said first and second bores defining between them a thin rupturable diaphragm integral with said body, said diaphragm being recessed from said first and second ends by said first and second bores to provide protection for said diaphragm against external damage, (d) said diaphragm having a thickness and area selected for said diaphragm to rupture at a predetermined pressure.

In another aspect, the invention provides a method of providing means in a container for relieving pressures in excess of a predetermined pressure in said container, said method comprising:

(a) selecting a container having a wall, with an opening in said wall;

(b) providing a pressure relief device having (i) a body formed from a resilient material and having first and second ends, said body being shaped to fit within and to seal said opening in said container, (ii) a first bore extending into said body from said first end and a second bore extending into said body from said second end, (iii) said first and second bores defining between them a thin rupturable diaphragm integral with said body, said diaphragm being recessed from said first and second ends by said first and second bores to provide protection for said diaphragm against external damage, and (iv) said diaphragm having a thickness and area selected for said diaphragm to rupture at a predetermined pressure;

(c) mounting said pressure relief device on an insertion means; and (d) manipulating said insertion means to place said pressure relief device in said opening, and then removing said insertion means leaving said pressure relief device in-said opening.

Further objects and advantages of the invention will appear from the following description, taken together with the accompanying drawings.

BRIEF DESCRIPTION OF THE DRAWINGS

For a better understanding of the present invention, and to show more clearly how it may be carried into effect, reference will now be made, by way of example, to the accompanying drawings, which show a preferred embodiment of the present invention, and in which.

DESCRIPTION OF THE PREFERRED EMBODIMENT

A preferred embodiment of the pressure relief device of the invention will now be described. The embodiment described is intended for use with aerosol containers that are filled with propellants such as Propellent-22 having steep pressure/temperature curves. It will be understood that the dimensions of the pressure relief device may be altered so that it may conform to the safety release parameters of aerosol containers containing other propellants. In addition, the pressure relief device of the invention may be used with non-aerosol containers that are subject to internal or external pressures.

Figure 1:
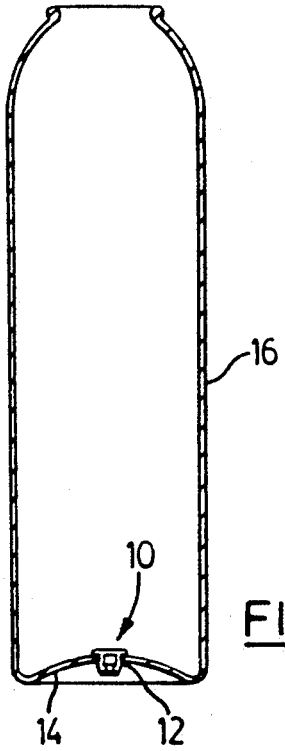
FIG. 1 is a sectional view of an aerosol container having a pressure relief device fitted within its casing.
Figure 2:
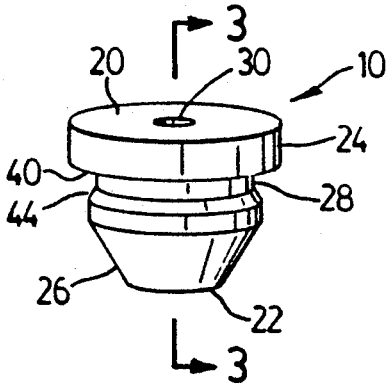
FIG. 2 is a perspective view of a pressure relief device in accordance with the present invention.
Figure 3:
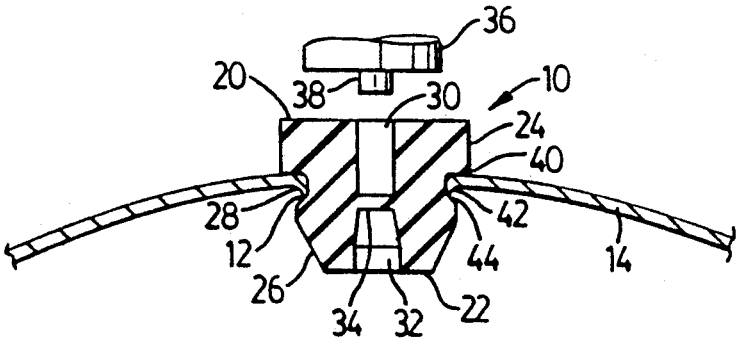
FIG. 3 is a sectional view of the pressure relief device shown in FIG. 2 along lines 3—3, installed in a container.
Figure 4:
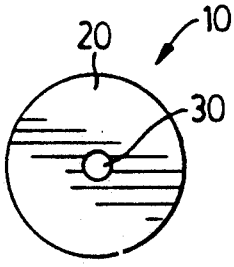
FIG. 4 is an end view of the pressure relief device of FIGS. 2 and 3.

Reference is first made to FIGS. 1 to 4 which show a pressure relief device 10 according to the invention. The device 10 is shown in FIGS. 1 and 3 as fitted within an opening 12 located in the bottom 14 of an aerosol container 16.

The pressure relief device 10 is typically compression molded from a rubber material such as neoprene W (made by the Dupont Company) although it is conceivable that a plastic or other material may be used. The relief device 10 is round as viewed from either end and has first and second round generally flat end faces (i.e. ends) 20, 22. The ends 20, 22 are spaced apart by a first cylindrical sidewall 24 adjacent end 20, a second and tapered sidewall 26 adjacent end 22, and a rounded groove 28 between sidewalls 24, 26. As shown, end 20 is of larger diameter than end 22 and is also of larger diameter than the largest diameter portion of tapered sidewall 26.

The inner diameter of the groove 28 is the same as the diameter of the opening 12, although it can also be slightly larger or smaller. The thickness (i.e. height) of the groove 28 is slightly greater than the thickness of the bottom wall 14 of the container 16. The groove 28 therefore allows the pressure relief device 10 to fit slightly loosely within the opening 12 of the container 16. The loose fit allows the device 10 to be easily inserted into the opening 12 without damage to the device 10. Preferably the device 10 is lubricated with a silicone spray to ease its insertion into the opening 12 of the container 16.

A first bore 30 extends axially into the device 10 from the end face 20, and a second bore 32 extends axially into the device 10 from the second end face 22. The bores 30, 32 are coaxial and their common axis is preferably coincident with the axis of the device 10, and hence is normal to the end faces 20, 22.

The bores 30, 32 do not meet but instead define between them a thin rupturable diaphragm 34. As shown, the diaphragm 34 is integral with the remainder of the device 10. The thickness and area of the diaphragm 34 may be varied to control the desired critical pressure at which the diaphragm 34 must rupture.

As shown, the bore 32 tapers outwardly (i.e. increases in diameter) from the diaphragm 34 to the end face 22. The outward tapering reduces the resistance to flow of gases from the container through the bore 32 when the diaphragm 34 ruptures. The bore 30 is not tapered since the contents of the aerosol container are usually in a liquid phase, so that the cylindrical shape of bore 30 is normally adequate for venting.

The pressure relief device 10 is normally inserted into the opening 12 by placing it on an insertion means such as a pin 36 having a small extension 38. The extension 38 penetrates part way into the bore 32 to locate and hold the pressure relief device 10 on the pin 36. The extension 38 does not penetrate into the bore 30 as far as the diaphragm 34, in order to avoid damage to the diaphragm.

As shown in FIGS. 1 and 3, the device 10 is normally inserted into the container from the inside, so that the tapered sidewall 26 is located outside the container. The tapered sidewall 26 facilitates insertion of the device 10 into the opening 12, and the material of the device 10 yields sufficiently to allow the largest diameter portion of sidewall 26 to be forced through the opening 12.

Once the device 10 has been inserted into the opening 12 so that the groove 28 accommodates bottom wall 14, the device 10 remains positioned in the opening 12 and cannot fall out. The containers can then be shipped from their manufacturer to a filler where they are filled with contents and propellent. At such time the internal pressure in the container 16 will force the upper radially extending wall 40 of groove 28 downwardly against the bottom wall 14 of the container, ensuring a hermetic seal around the opening 12. The wall 40 prevents the device 10 from being blown out of the opening 12. The diameter of the wall 40 relative to the diameter of opening 12 may be increased for containers having a greater internal pressure, to guard further against blow out.

Because the diaphragm 34 is integral with the remainder of the device 10, the device 10 is simple to manufacture. The thickness of the diaphragm 34 can be easily adjusted by controlling the depth of penetration of the pins (not shown) used in the molding process to form bores 30, 32. In addition, since the diaphragm 34 is recessed within the device, preferably near the axial center of the device, well away from each end face 20, 22, it is reasonably well protected against damage which can occur when the aerosol container is being handled during shipping and filling, and which can also occur when the container is on a store shelf.

The opening 12 in the container bottom wall 14 is usually formed by punching, using a punch which penetrates the wall 14 from the inside of the container. This produces a burr 42 as shown in FIG. 3. The burr 42 acts as a chamfer which helps ease the movement of the device 10 into the opening 12. The height of groove 28 is normally sufficient to accommodate the burr 42, although this is not strictly necessary since materials such as neoprene W are sufficiently resilient to stretch to accommodate the burr 42.

While the device 10 is preferably inserted as shown in FIGS. 1 and 3, with the end face 22 facing outwardly of the container, the device 10 can be inserted oppositely so that the end face 22 is located inside the container and the face 20 is located outside the container. In such event the lower radially extending wall 44 of the groove 28 must be of large enough diameter to provide an adequate seal against the inside of the container bottom wall 14.

Figure 5:
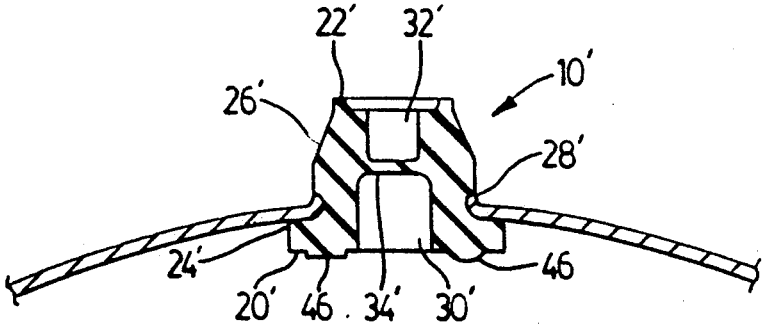
FIG. 5 is a sectional view of an alternative embodiment of a pressure relief device in accordance with the present invention.

Another embodiment of the invention is shown in FIG. 5, where primed reference numerals indicate the parts corresponding to those of FIGS. 1-4. In the FIG. 5 embodiment, the device 10' has been inserted oppositely to the direction shown in FIGS. 1 to 4. The bore 32' has been made straight (i.e. cylindrical), and the bore 30' (which now faces outwardly of the container) has been made of larger diameter than bore 32', in order to offer less restriction to the venting of gases.

FIG. 5 also shows a number of anti-nesting beads 46 located on end surface 20'. The anti-nesting beads 46 help to prevent the devices 10 from sticking together when they are grouped in a vibration bowl for insertion into aerosol containers.

When the devices 10 are to be inserted into aerosol containers, various techniques may be used. Because the end of device 10 at which end face 20 is located is heavier than the other end of the device 10, the device 10 will become oriented with the end face 20 facing downwardly when it is placed in a vibration bowl. The pressure relief devices 10 can then be made to travel from the vibration bowl along an inclined track that is provided with openings which allow incorrectly oriented devices 10 to fall back into the vibration bowl. The correctly oriented devices are then fed into a narrow track where they are individually collected by the insertion pins 36. The insertion pins 36 then insert the device 10 into openings 12 of containers 16 which have been punched during an earlier punching operation. Once the devices 10 are inserted into the openings 12, the grooves 24 loosely grip the perimeters of the opening so that the insertion pins 36 may be withdrawn. The containers with the devices 10 installed may then be filled with propellent and contents.

If desired, the sidewall 26 and a portion of the groove 28 adjacent thereto may be "scalloped" as shown in U.S. Pat. No. 4,658,979 issued Apr. 21, 1987 to Mietz et al. This forms axially extending grooves around the circumferential groove 28, allowing propellent to be directed into the container from beneath its bottom, through the axially extending grooves, as described in that patent. Once the source of propellent has been removed, the pressure inside the container will as before force the device 10 downwardly, creating a seal between wall 40 of the device 10 and the container bottom wall 14.

As discussed, the thickness and area of diaphragm 34 will depend on the pressure at which the diaphragm must rupture. A conventional aerosol container may legally rupture or burst at an internal pressure of about 270 psig. Therefore the diaphragm 34, when used in a conventional aerosol container, should be dimensioned to rupture at an internal pressure of no greater than about 180 to 200 psig.

Aerosol containers which use new propellants such as Propellant-22 must be much stronger and can typically withstand internal pressures of at least 600 psig. However U.S. Department of Transport Regulations concerning transportation of hazardous materials provide that aerosol containers containing propellants such as Propellant-22 may be transported only if they have pressure relief devices that rupture within the range 315-480 psig. For this use the device 10 typically has the following dimensions (all millimeters):

| | |
|---|---|
| Diameter of diaphragm 34 | 1.7 |
| Thickness of diaphragm 34 | 0.58 |
| Length of bore 30 | 3.65 |
| Length of bore 32 | 3.05 |
| Diameter of bore 32 at face 22 | 2.25 |

-continued

| | |
|---|---|
| Diameter of end face 20 | 9.0 |
| Diameter of end face 22 | 5.12 |
| Inner diameter of groove 28 | 6.6 |
| Widest diameter of sidewall 26 | 7.50 |
| Diameter of hole 12 | 6.6 |

The diaphragm 34 having the dimensions described above was hydrostatically pressure tested with tap water under laboratory conditions and found to rupture at a pressure of 400±30 psig. It is found that the rupture pressure can relatively easily be accurately determined within a narrow range.

The dimensions given above are of course exemplary and will differ according to manufacturing and installation requirements and according to the desired rupture characteristics. For example, the diaphragm 34 will be thinner when a lower rupture pressure is needed. It is found that for a given diameter, the rupture pressure of the diaphragm varies generally linearly with the thickness of the diaphragm.

Figure 6:
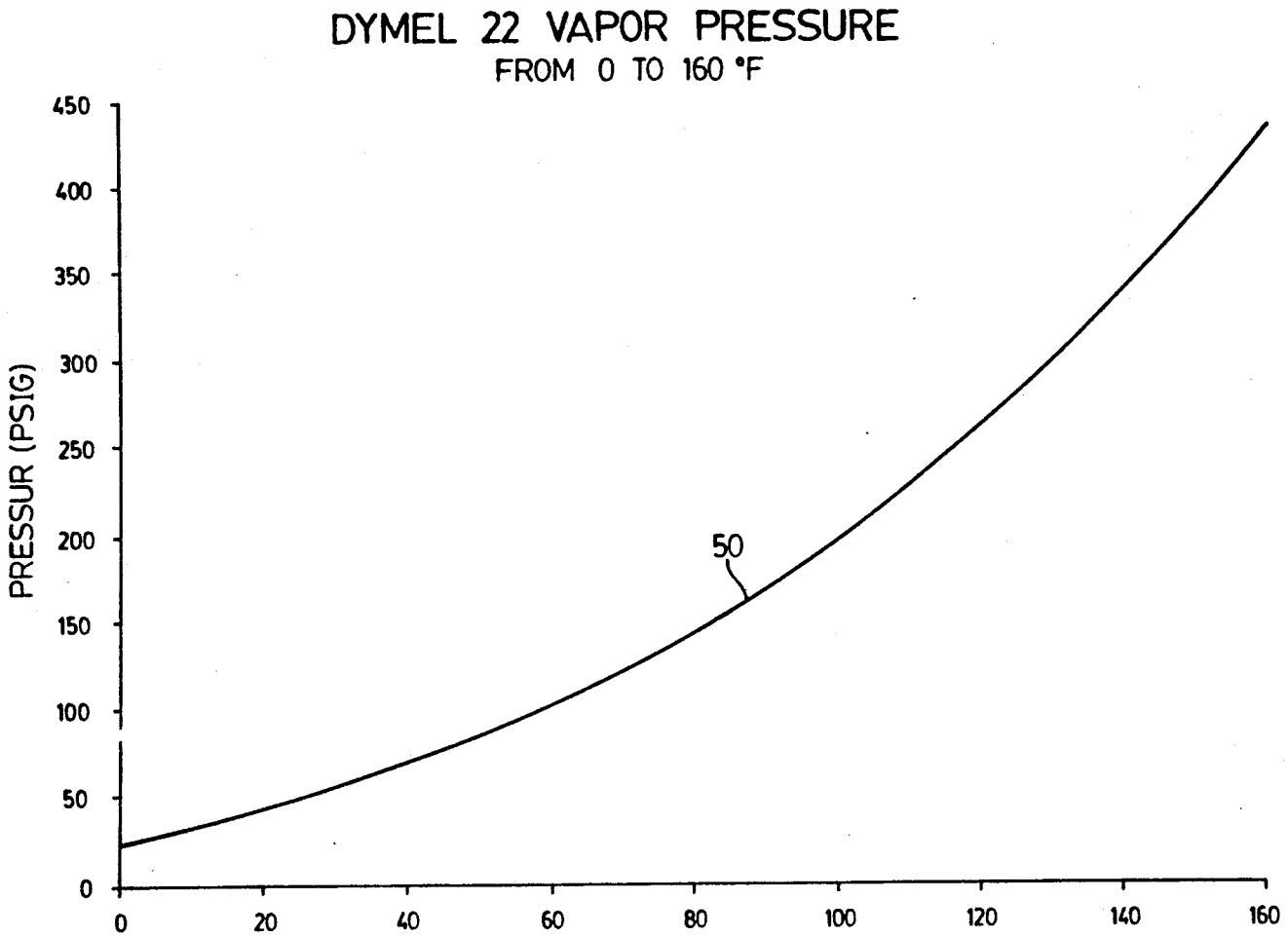
FIG. 6 is a graph showing the relationship between pressure and temperature for an aerosol propellent known as DYMEL-22 which is a trade mark of the Dupont Company relating to Propellent-22.

By way of added illustration, reference is next made to FIG. 6, which shows at 50 a vapor pressure curve for a form of Propellant-22 sold by Dupont known as DYMEL-22. Temperature in degrees F is plotted on the horizontal axis and pressure (psig.) is plotted on the vertical axis. It will be seen that the vapor pressure increases from about 25 psig. at 0° F. to 425 psig. at 160° F. This enormous increase in pressure can cause serious risk of explosion, which risk is alleviated by the present invention.

While the bores 30, 32 are described as being coaxial, they can if desired be slightly offset, or they can be arranged to provide a diaphragm which is non-planar. In addition, if desired more than one set of bores can be provided, creating multiple rupturable diaphragms rather than a single diaphragm. The diaphragm will of course always be very thin.

It is understood that preferred embodiments of the invention have been described, and that changes and alternative embodiments may be made within the spirit of the invention as defined by the appended claims.

We claim:

1. A pressure relief device for use in pressurized containers such as aerosol containers, for relieving pressures in excess of predetermined pressure, said device comprising:

(a) a body formed from a resilient material and having first and second ends, said body being shaped to fit within and seal an opening in said container, (b) a first bore extending into said body from said first end and a second bore extending into said body from said second end, (c) said first and second bores defining between them a thin rupturable diaphragm integral with said body, said diaphragm being recessed from said first and second ends by said first and second bores to provide protection for said diaphragm against external damage, (d) said diaphragm having a thickness and area selected for said diaphragm to rupture at a predetermined pressure, (e) said second bore having an internal diameter adjacent said diaphragm equal to that of said first bore, said second bore tapering outwardly from said diaphragm to said second end.

2. An aerosol container for releasably holding pressurized fluid, said container comprising:

(a) a casing for holding said pressurized fluid, said casing having an upper portion adapted to receive a dispensing valve, and a bottom wall which is concave upwardly to define a concavity therebelow, with an opening in said bottom wall, (b) a pressure relief device inserted into said opening for relieving pressures in said container in excess of a predetermined pressure, said pressure relief device comprising:

(i) a body formed from a resilient material and having first and second ends, said body having a groove extending circumferentially around its perimeter, said groove being shaped to fit within said opening in said bottom wall for said body to extend above and below said wall with said first end inside said container and said second end outside said container in said concavity and for said body to seal said opening in said bottom wall, (ii) a first bore extending into said body from said second end, (iii) said first and second bores defining between them a thin rupturable diaphragm integral with said body, said diaphragm being recessed from said first and second ends by said first and second bores to provide protection for said diaphragm against external damage, (iv) said diaphragm having a thickness and area selected for said diaphragm to rupture at a predetermined pressure, (v) said first bore being cylindrical and said second bore having an internal diameter which is greater than that of said first bore at least adjacent said second end.

3. A pressure relief device according to claim 1 or 2, wherein said bores are substantially coaxial.

4. A pressure relief device according to claim 3, wherein said diaphragm is located approximately in a central portion axially of said device.

5. A pressure relief device according to claim 3, wherein said body is tapered adjacent one of said ends to facilitate insertion of said body into said opening.

6. A pressure relief device according to claim 5, wherein said body includes a substantially radially extending sealing wall for sealing said opening.

7. A pressure relief device according to claim 6, wherein said sealing wall forms a portion of a groove extending circumferentially about the perimeter of said body, said groove being of a height and internal diameter dimensioned to hold said body within said opening.

8. An aerosol container for releasably holding pressurized fluid, said container comprising:

(a) a casing for holding said pressurized fluid, said casing having an upper portion adapted to receive a dispensing valve, and a bottom wall which is concave upwardly to define a concavity therebelow, with a substantially central opening in said bottom wall, (b) a pressure relief device inserted into said opening for relieving pressures in said container in excess of a predetermined pressure, said pressure relief device having (i) a very small body formed from a resilient rubber material and having first and second ends, said body having a groove extending circumferentially around its perimeter, said groove being shaped to fit within said opening in said bottom wall for said body to extend above and below said wall with said first end inside said container and said second end outside said container in said concavity and for said body to seal said opening in said bottom wall, (ii) a first bore extending into said body from said first end and a second bore extending into said body from said second end, (iii) said first and second bores defining between them a thin rupturable diaphragm integral with said body, said diaphragm being recessed from said first and second ends by said first and second bores to provide protection for said diaphragm against external damage, (iv) said diaphragm having a thickness and area selected for said diaphragm to rupture at a predetermined pressure, (v) said body being tapered from said groove toward said second end to facilitate insertion of said body from above said bottom wall into said opening.

9. A container according to claim 8, wherein said bores are substantially coaxial.

10. A container according to claim 9, wherein said diaphragm is located approximately in a central portion axially of said device.

11. A method of providing means in a container for relieving pressures in excess of a predetermined pressure in said container, said method comprising:

(a) selecting a container having a wall, with an opening in said wall, (b) providing a pressure relief device having (i) a body formed from a resilient material and having first and second ends, said body being shaped to fit within and to seal said opening in said container, (ii) a first bore extending into said body from said first end and a second bore extending into said body from said second bore, (iii) said first and second bores defining between them a thin rupturable diaphragm integral with said body, said diaphragm being recessed from said first and second ends by said first and second bores to provide protection for said diaphragm against external damage, and (iv) said diaphragm having a thickness and area selected for said diaphragm to rupture at a predetermined pressure;

(c) mounting said pressure relief device on an insertion pin, said insertion pin having an extension that is adapted to extend into one of said bores, said extension being shorter in length than said one bore so as not to damage said diaphragm; and (d) manipulating said insertion means to place said pressure relief device in said opening, and then removing said insertion means leaving said pressure relief device in said opening.

12. The method according to claim 11, wherein said container is an aerosol container and said wall is a bottom wall of said container.

13. A method according to claim 12 wherein said pressure relief device is inserted from above said bottom wall of said container downwardly into said bottom wall.

14. A container according to claim 9 wherein said groove is thicker than the thickness of said wall, to facilitate insertion of said body into said opening.

15. A container according to claim 8 wherein the diameter of said diaphragm is approximately 1.7 mm.

* * * * *